US007861853B2

(12) United States Patent
Borg

(10) Patent No.: US 7,861,853 B2
(45) Date of Patent: Jan. 4, 2011

(54) COMBINATION MULTIPLE-CANISTER CARRIER AND TAMPER-RESISTANT LIP AND CAP PROTECTION DEVICE

(75) Inventor: Zakary James Borg, Eugene, OR (US)

(73) Assignee: Oregon Precision Industries, Inc., Eugene, OR (US)

( * ) Notice: Subject to any disclaimer, the term of this patent is extended or adjusted under 35 U.S.C. 154(b) by 327 days.

(21) Appl. No.: 12/221,355

(22) Filed: Aug. 1, 2008

(65) Prior Publication Data

US 2010/0025360 A1 Feb. 4, 2010

(51) Int. Cl.
*B65D 75/00* (2006.01)

(52) U.S. Cl. ..... 206/151; 206/158; 206/159; 294/87.2; 294/87.28

(58) Field of Classification Search ..... 206/159, 206/158, 153, 151, 427, 138; 220/266, 796; 215/251, 254; 294/87.2, 87.28, 159
See application file for complete search history.

(56) References Cited

U.S. PATENT DOCUMENTS 3,258,288 A * 6/1966 Courter ..... 294/87.2
3,664,497 A * 5/1972 Mascia ..... 206/151
3,901,403 A * 8/1975 Menke ..... 215/251
4,823,959 A * 4/1989 Bixler ..... 206/562
RE35,288 E 7/1996 Borg
5,735,562 A 4/1998 Borg
6,129,397 A 10/2000 Borg
6,394,517 B1 5/2002 Borg
6,715,810 B2 4/2004 Borg
6,789,828 B1 9/2004 Borg
6,808,070 B2 10/2004 Borg
7,108,128 B2 9/2006 Borg
7,147,100 B1 12/2006 Borg
7,377,382 B2 5/2008 Borg et al.
7,387,200 B2 6/2008 Borg
7,588,275 B2 * 9/2009 Borg ..... 294/87.2
2007/0296231 A1 12/2007 Borg
2008/0224489 A1 9/2008 Borg

* cited by examiner

*Primary Examiner*—David T Fidei
(74) *Attorney, Agent, or Firm*—Chernoff, Vilhauer, McClung & Stenzel

(57) ABSTRACT

A beaded lip protection and tamper-resistant device for canisters with caps is disclosed, as well as multiples of the same device joined together to form multiple-canister carriers that may be provided with one or more handles.

9 Claims, 3 Drawing Sheets

COMBINATION MULTIPLE-CANISTER CARRIER AND TAMPER-RESISTANT LIP AND CAP PROTECTION DEVICE

BACKGROUND OF THE INVENTION

Recently a new style of canister was developed for containing beverages or other fluids, the canister having an annular lip and a screw-top cap as shown in FIG. 1. The caps on cans and canisters of the type shown in FIG. 1 are either screwed on or snapped on with a compression fit. Because of this, they are susceptible to being removed prior to purchase to gain access to the contents. There is therefore a need for a device of simple construction that is capable of protecting such beverage cans from damage and at the same time discouraging tampering or unwanted removal of the cap. These needs are met by the present invention.

There is also an ongoing need in the industry for carriers of simple lightweight construction and easy application that are capable of bundling a plurality of such cylindrical containers or canisters into a single package to be transported, displayed, stored, stacked or sold as a single unit. This need is also met by the present invention.

BRIEF SUMMARY OF THE INVENTION

According to the present invention, there is provided a device for protecting annular beaded rims of canisters of the type shown in FIG. 1 and discouraging tampering or removal of caps from such canisters that snaps on the top of such canisters, and that, when joined with one or more other such devices, may form a combination bundler and carrier for multiples of such canisters.

DETAILED DESCRIPTION OF PREFERRED EMBODIMENTS

Figure 1:
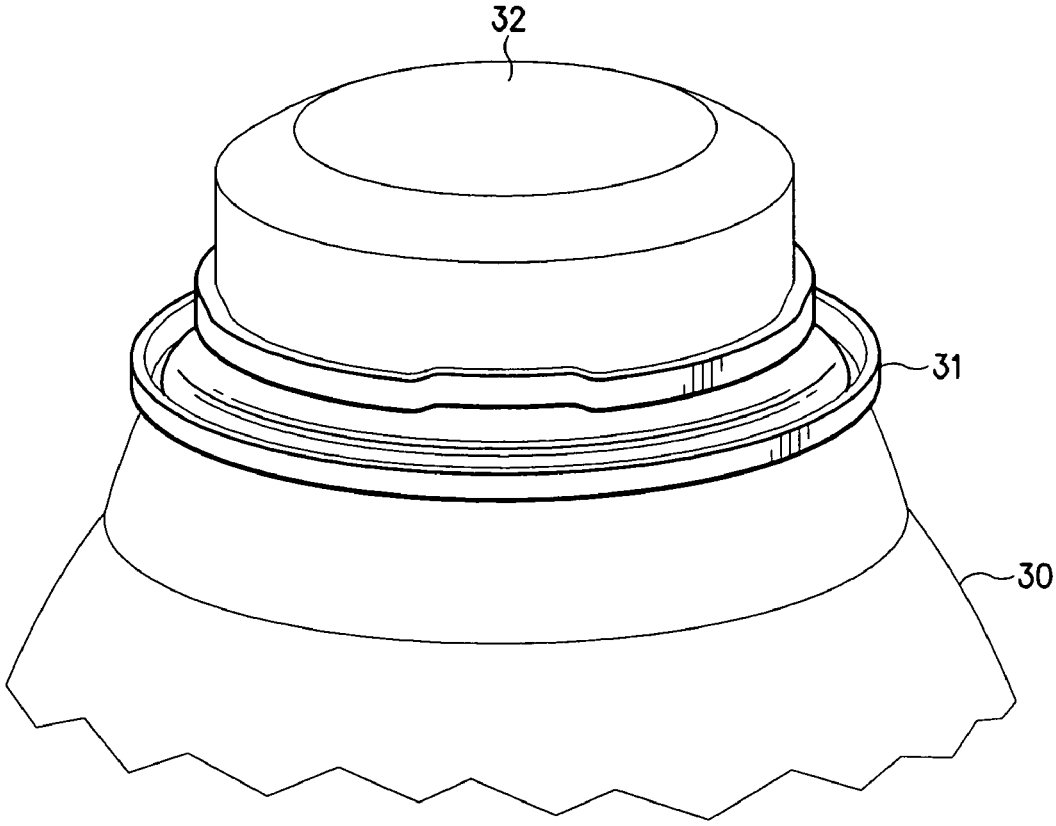
FIG. 1 is a front perspective view of the style of canister for which the device of the invention was developed.
Figure 2:
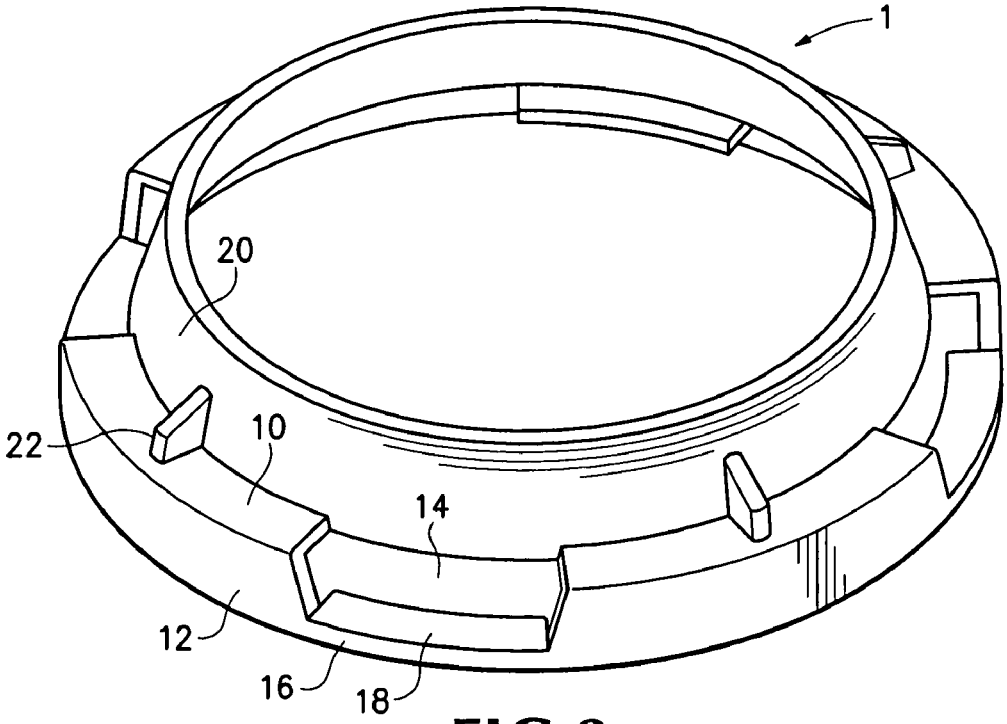
FIG. 2 is a top perspective view of an exemplary container lip and cap protection device of the invention.

Referring to the drawings, wherein the same numerical references generally refer to like elements, there is shown in FIGS. 2-5 various embodiments of the invention for protecting annular beaded rims and caps of canisters 30 of the design shown in FIG. 1. In its simplest form, the device comprises a substantially planar annular ring 10 having a plurality of downwardly projecting flanges 12 with arcuate gaps 14 between adjacent flanges. Each arcuate gap 14 is encompassed on its top side by planar ring 10 and on its bottom side by an arcuate segment 16 connecting adjacent flanges 12, and each arcuate segment 16 in turn is provided with an inwardly extending arcuate lip 18 that is substantially parallel to planar ring 10. Device 1 is also provided with an inwardly sloping annular wall 20 on the top side of planar ring 10 and with multiple ribs 22 joining the annular wall to the planar ring, which serve to reinforce the device.

Device 1 is preferably made of a resilient material such as high density polyethylene by injection molding. Use of a resilient material allows arcuate lips 18 to snugly engage the underside of a beaded rim 31 of canister 30 with spring-like force by simply pressing downwardly in the vicinity of opposing gaps 14 to slightly deform planar ring 10 while pulling corresponding arcuate lips 18 outwardly away from beaded rim 31, then releasing.

Simultaneously with capturing beaded rim 31, inwardly sloping annular wall 20 snugly engages the canister's cap 32 so as to thwart the cap's removal without completely removing device 1. To release the device from beaded rim 31 and cap 32, the same "press/pull" forces are exerted, followed by separating the device and the canister.

Figure 3:
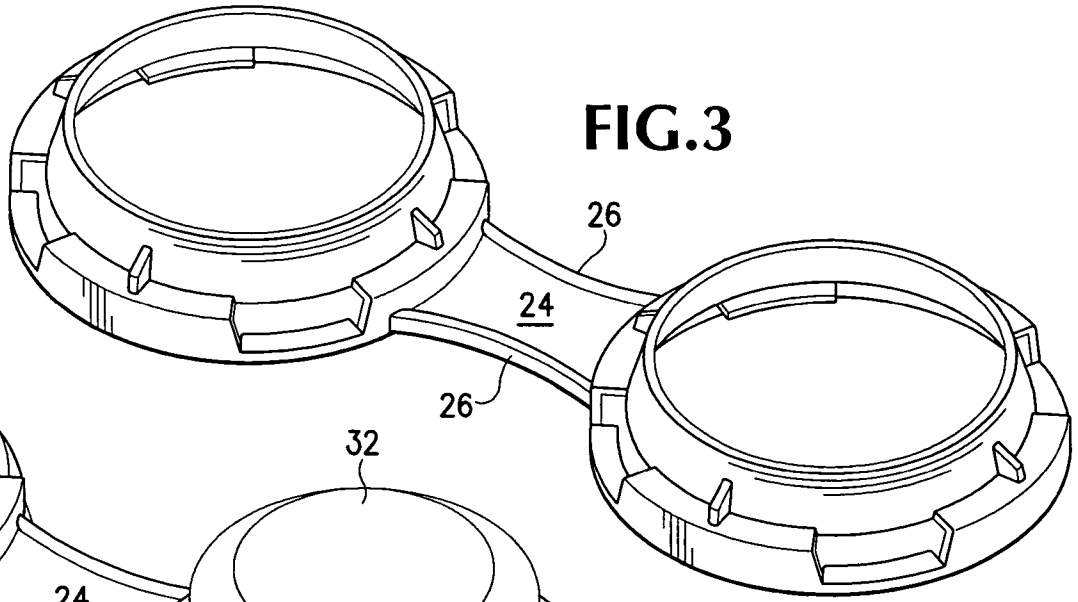
FIG. 3 is a top perspective view of an exemplary carrier of the invention comprising two of the device shown in FIG. 2 joined together.
Figure 4:
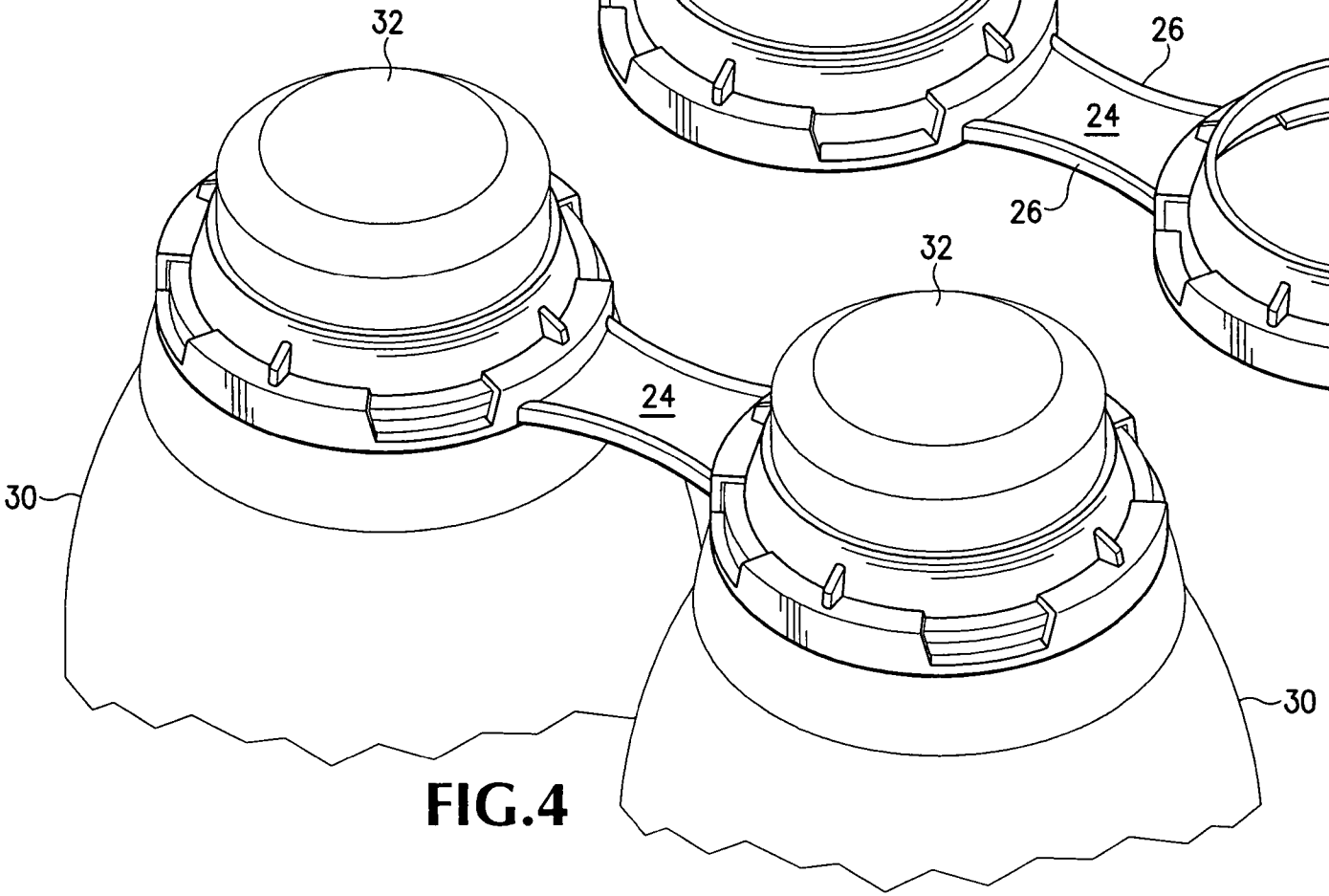
FIG. 4 is a top perspective view of the carrier of FIG. 3 in place over two of the canisters of FIG. 1.
Figure 5:
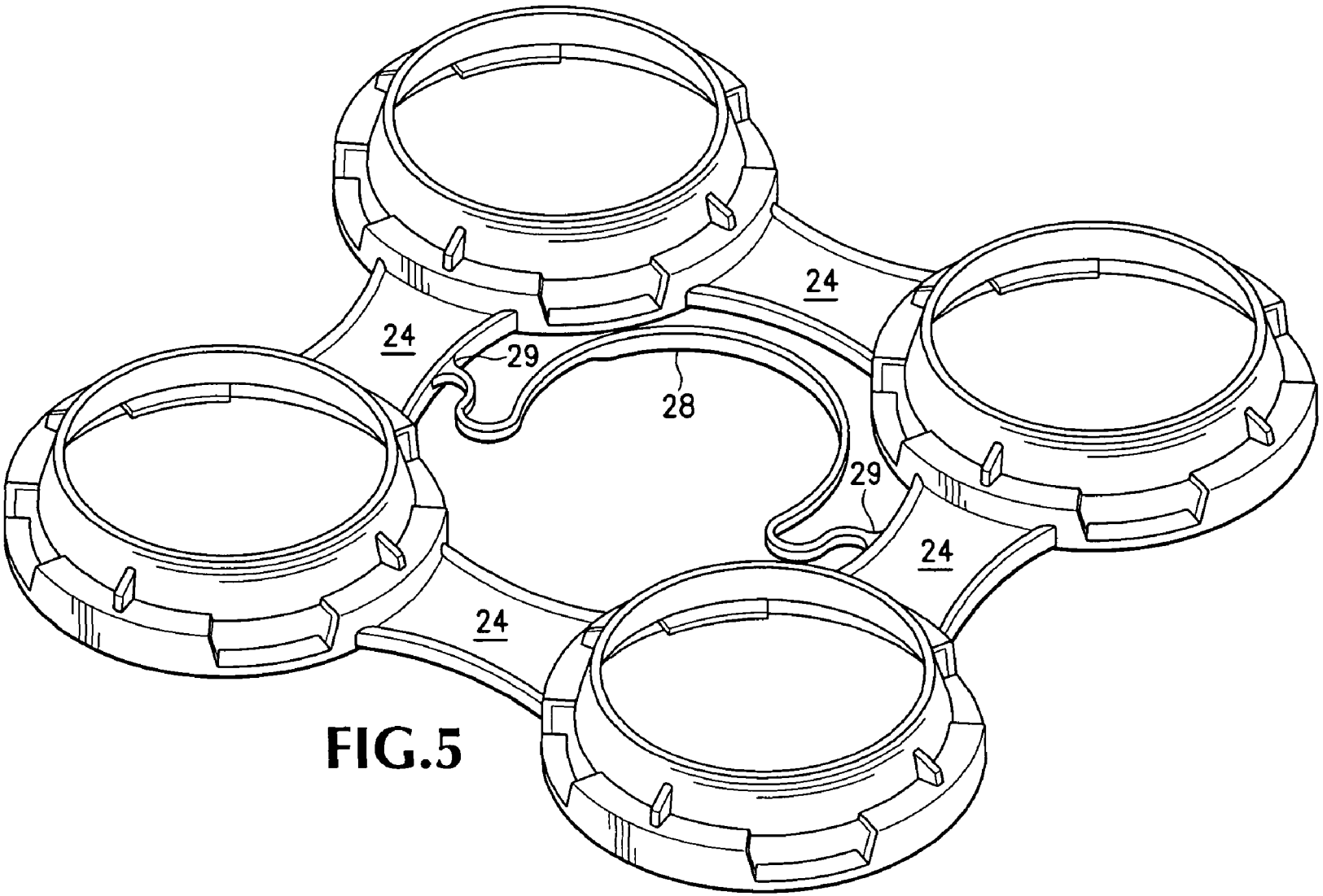
FIG. 5 is a top perspective view of another exemplary carrier of the invention comprising four of the device shown in FIG. 2 joined together and provided with a U-shaped handle.

Multiples of device 1 may be joined together in substantially the same plane by webs 24 attached to flanges 12 so as to form multiple-canister carriers, as shown in FIGS. 3 and 5; for extra rigidity, web 24 may be provided with reinforcing ribs 26. Such multiple-canister carriers are also preferably made by injection molding. As shown in FIGS. 3-4, web 24 may serve as a carrying handle when two of the devices are joined together.

As shown in FIG. 5, multiple-canister carriers may be provided with carrying handles in the form of a substantially U-shaped half-loop 28, flexibly attached at balance points 29 that are midway between opposing webs 24. Loop 28 normally lies in substantially the same plane of the multiple canister carrier, thereby permitting efficient nesting of multiple carriers and stacking of bundles of canisters to which the carriers have been applied. But when grasped for carrying, loop 28 pivots upwardly away from the plane of the multiple canister carrier by virtue of gravitational pull on the canisters to which annular rings 10 have been applied.

The device and multiples thereof may be applied to any manner of cylindrical containers or canisters bearing annular beaded rims and caps on their tops as depicted in FIG. 1, such as food cans, beverage cans, filter housings, bullet casings, artillery shells and other ordinance packaged in canisters.

The terms and expressions which have been employed in this specification are used as terms of description and not of limitation, and there is no intention in the use of such terms and expressions to exclude equivalents of the features shown and described or portions thereof, it being recognized that the scope of the invention is defined and limited only by the claims which follow.

The invention claimed is:

1. A device for protecting annular beaded rims of canisters and for discouraging removal of caps on said canisters comprising (a) a substantially planar ring with a plurality of downwardly projecting flanges with arcuate gaps between adjacent flanges, each of said arcuate gaps having a top side and a bottom side, each of said gaps being bordered on its top side by said planar ring and on its bottom side by an arcuate segment connecting adjacent flanges, said arcuate segment having an inwardly extending arcuate lip substantially parallel to said planar ring; and (b) an inwardly sloping annular wall on said planar ring, said wall having multiple ribs joining said wall to said planar ring.

2. The device of claim 1 made of resilient material.

3. The device of claim 2 wherein said resilient material is high density polyethylene.

4. A carrier for multiple canisters having annular beaded rims and caps comprising a plurality of the device of claim 3 joined together in substantially the same plane by one or more substantially planar webs.

5. The carrier of claim 4 wherein said plurality is two.

6. The carrier of claim 4 wherein said plurality is four.

7. The carrier of claim 4 wherein said plurality is six.

8. The carrier of 6 or 7 further comprising a handle.

9. The carrier of claim 8 wherein said handle comprises a substantially U-shaped half-loop.

* * * * *